United States Patent [19]

Knitter et al.

[11] 4,363,637

[45] Dec. 14, 1982

[54] STABILIZED OIL SLURRIES OF CARBONACEOUS MATERIALS

[75] Inventors: Kathy A. Knitter, Morristown; José L. Villa, Bridgewater, both of N.J.

[73] Assignee: Diamond Shamrock Corporation, Dallas, Tex.

[21] Appl. No.: 252,023

[22] Filed: Apr. 8, 1981

[51] Int. Cl.[3] ..... C10L 1/22

[52] U.S. Cl. ..... 44/51; 44/63; 44/71; 44/72

[58] Field of Search ..... 44/51, 71, 72, 63; 252/357

[56] References Cited

U.S. PATENT DOCUMENTS

| | | | |
|---|---|---|---|
| 1,940,445 | 12/1933 | Calcott et al. | 44/72 |
| 1,989,528 | 1/1935 | Rather et al. | 44/72 |
| 2,002,645 | 5/1935 | Rather et al. | 44/71 |
| 2,695,222 | 11/1954 | Chenicek et al. | 44/72 |
| 2,759,975 | 8/1956 | Chiddix et al. . | |
| 3,088,796 | 5/1963 | Kahler et al. . | |
| 3,205,169 | 9/1965 | Kirkpatrick et al. | 252/357 |
| 4,069,022 | 1/1978 | Metzger | 44/51 |
| 4,088,453 | 5/1978 | Wiese et al. | 44/51 |
| 4,201,552 | 5/1980 | Rowell et al. . | |

*Primary Examiner*—Charles F. Warren
*Assistant Examiner*—Y. Harris Smith
*Attorney, Agent, or Firm*—Leslie G. Nunn, Jr.

[57] ABSTRACT

Mixtures of an alkoxylated quaternary salt and a nitrogen base having from zero to nine carbon atoms are added to carbonaceous materials in oil slurries such as a coal oil mixture (COM) or a coke oil mixture in an amount sufficient to stabilize the slurries during storage and dispersing at various temperatures. Useful stabilizer mixtures include a mixture of from about 99% to about 75% by weight of an alkoxylated quaternary salt which is a reaction product of a cocoamine ethoxylate and diethyl sulfate and from about 1% to about 25% by weight of a nitrogen base such as urea. The stabilizer mixtures may be added to either the oil or slurry (or during grinding of the carbonaceous material) and are effective with or without addition of water. Coal/coke oil slurries may contain from about 40 to about 90 parts by weight of oil, about 10 to about 60 parts by weight of powdered coal or coke, about 0.01 to about 6.0 parts by weight of the stabilizer mixture and about 0 to about 10 parts by weight of water.

10 Claims, No Drawings

STABILIZED OIL SLURRIES OF CARBONACEOUS MATERIALS

BACKGROUND OF THE INVENTION

1. Field of the Invention

This invention relates to carbonaceous materials in oil slurries and more particularly to stabilized coal or coke in oil slurries containing mixtures of an alkoxylated quaternary salt and a nitrogen base having from zero to nine carbon atoms as stabilizers.

2. Description of the Prior Art

Addition of solid particulate carbonaceous material, such as coal or coke, to a liquid hydrocarbon fuel, such as fuel oil, has been studied for many years. In the past five years, and particularly during the last two years, importance of reducing dependency of the world upon natural gas and liquid hydrocarbon fuels for its energy has been dramatically demonstrated.

Though not providing a complete solution to this energy problem, attempts have been made to incorporate solid particulate carbonaceous material, such as coal and coke, in liquid hydrocarbon fuels, because these particulate carbonaceous materials are far more plentiful than liquids fuels. There is considerable interest in extending and/or supplementing liquid fuels with solid fuels.

Many large industrial fuel users have equipment which was designed and constructed for the transportation, storage and combustion of liquid fuels. As yet, solid-liquid slurries, suspension or emulsions are not accepted for regular use in such conventional equipment. In some instances this equipment was converted from its original design for burning solid fuels to liquid fuels. Many believe this trend should be reversed.

Various solutions to the problem of combining a solid particulate carbonaceous material with a liquid hydrocarbon fuel have been explored. One solution involved grinding carbonaceous material to colloidal size before introducing it into an oil. Even though this solution was successful, grinding costs were prohibitive. Coal oil slurries tend to form gels when heated to usable temperatures during storage, usually thixotropic gels.

Attempts were made to use the gelling phenomenon to hold larger than colloidal size particles in suspension. The gel was later broken down by adding additional oil so that the resulting slurry was pumpable without particulate material settling out. Inherently, this procedure was an expensive batch process.

Various materials were also added in an attempt to stabilize a coal oil slurry against settling of larger than colloidal size coal particles. Lime-rosin and starch were added to prevent settling of the larger slurry particles. Casein, gelatin and rubber were also added as suspension stabilizing agents to inhibit settling of coal particles. It was found that these suspension stabilizing agents must be added in quantities which undesirably thicken and increase viscosity of the slurry in order to prevent substantial quantities of coal particulate material from settling. Increasing slurry viscosity not only reduced the settling problem, but also limited uses to which the slurry may be put.

U.S. Pat. No. 4,069,022—Metzger, issued Jan. 17, 1978, describes a substantially water-free, high solid content, stable and combustible fuel slurry of about 5 to about 50 weight percent of a solid particulate carbonaceous material with the balance of the slurry being a liquid hydrocarbon fuel, a slurry suspension stabilizing agent and a water-free slurry viscosity reducing agent. The viscosity reducing agent was present in an amount sufficient to maintain the slurry at a viscosity below about 300 seconds Saybolt Universal when the slurry is at a temperature of 175° F. Preferably, the viscosity reducing agent was a soap and the suspension stabilizing agent was starch.

The process for preventing formation of a gel in and controlling the settling and viscosity of this slurry involved the step of adding to the slurry containing a suspension stabilizing agent, a soap or salt of a fatty acid in an amount sufficient to maintain the viscosity of the slurry below 300 seconds Saybolt Universal when the slurry temperature was 175° F.

U.S. Pat. No. 4,201,552—Rowell et al, issued May 6, 1980, describe coal oil slurries stabilized with certain cationic surfactants having the group $$>N-CH_2-CH_2-O-$$

where the group forms part of a straight chain such as Ethomeen® C-20 or cyclic ring such as N-soya-N-ethyl morpholinium ethosulfate.

U.S. Pat. No. 2,759,975—Chiddix et al, issued August 21, 1956, describe preparation of quaternary ammonium chlorides by reaction of ethoxylated fatty amines with benzyl- or alkylbenzyl chlorides.

U.S. Pat. No. 3,088,796—Kahler et al, issued May 7, 1963, describe use of an ethoxylated alkyl ($C_{10}$–$C_{29}$) amine quaternarized with methyl chloride as an emulsifier.

SUMMARY OF THE INVENTION

Mixtures of an alkoxylated quaternary salt and a nitrogen base having from zero to nine carbon atoms are added to carbonaceous materials in oil slurries such as a coal oil mixture (COM) or a coke oil mixture in an amount sufficient to stabilize slurries during storage and dispersing at various temperatures. The stabilizer mixtures are added to either the oil or slurry (or during grinding of the carbonaceous material) and are effective with or without addition of water. Coal/coke oil slurries may contain from about 40 to about 90 parts by weight of oil, about 10 to about 60 parts by weight of powdered coal or coke, about 0.01 to about 6.0 parts by weight of the stabilizer mixture and about 0 to about 10 parts by weight of water. Useful stabilizer mixtures include a mixture of from about 99% to about 75% by weight of an alkoxylated quaternary salt which is a reaction product of a cocoamine ethoxylate and diethyl sulfate and from about 1% to about 25% by weight of a nitrogen base such as urea.

DETAILED DESCRIPTION

Stabilizer mixtures may contain from about 99% to about 75% by weight of an alkoxylated quaternary salt obtained by reaction of a primary aliphatic amine having from about 7 to about 29 carbon atoms or mixtures thereof with from about 2 to about 50 moles of an alkylene oxide of 2 to 3 carbons followed by reaction with a quaternarizing agent such as an alkyl halide, alkylaryl halide, aralkyl halide, alkyl sulfate or the like. It should be noted that the anion of the quaternarizing agent may be other than that specifically cited. The anion may be any inorganic or organic acid capable of forming a salt. Useful quaternarizing agents include methyl chloride, benzyl chloride, dimethyl sulfate, diethyl sulfate and the like.

Preferred amines include 10 to 18 carbon atom aliphatic amines prepared by hydrogenation of fatty acids such as coconut acid, oleic acid, stearic acid, soya acids, tallow acids and the like. Suitable ethoxylated amines include ethoxylated amines derived from fatty acid residues where R' is a fatty acid residue of 10 to 30 carbon atoms and preferably 10 to 18 carbon atoms and the molar ratio of polyoxyethylene to R' is as follows:

coconut acids, $C_{10}$, $C_{12}$ and $C_{14}$, ratio of polyoxyethylene to R' varies from 2:1 to 15:1.

soya acids, $C_{16}$ to $C_{18}$ with some oleic, ratio of polyoxyethylene to R' varies from 2:1 to 15:1.

tallow acids, $C_{16}$ to $C_{18}$, containing some oleic, ratio of polyoxyethylene to R' varies from 2:1 to 5:1.

stearic acid, $C_{18}$, ratio of polyoxyethylene to R' varies from 2:1 to 50:1.

oleic acid, $C_{18}$ with one double bond, ratio of polyoxyethylene to R' varies from 2:1 to 5:1.

Propoxylated amines are prepared by reacting the amines described above with propylene oxide instead of ethylene oxide.

Nitrogen containing bases having from zero to nine carbon atoms constitute the balance of the stabilizer mixture. Stabilizer mixtures may contain from about 1% to about 25% by weight of the nitrogen containing bases.

Nitrogen containing bases having from zero to nine carbon atoms include ammonia, ammonium hydroxide, urea, diethanolamine, triethanolamine, aniline, methylamine, dimethylamine, trimethylamine, ethylamine, diethylamine, triethylamine, propylamine, dipropylamine, tripropylamine, monoethanolamine, monopropanolamine, dipropanolamine, tripropanolamine, their isomers their mixtures and the like. Thiourea as well as other amino bases such as dicyandiamide, ammeline, guanamines, guanidine, melamine and the like may also be used.

Stabilizer mixtures contain from about 99% to about 75% by weight of an alkoxylated quaternary salt and from about 1% to about 25% by a nitrogen containing base. These mixtures are prepared by blending the desired quantities of alkoxylated quaternary salt and nitrogen containing base until uniform and then adding the mixture to either the oil or slurry (or during grinding of the carbonaceous material). Sufficient mixture is added to stabilize the oil slurry during storage and dispersing at elevated temperatures.

The term "carbonaceous", as used herein, encompasses solid particulate carbonaceous fossil fuel materials which have been powdered or pulverized to a size where 70% to 90% or more passes through a 200 mesh screen. Useful carbonaceous materials include bituminous and anthracite coals, coke, petroleum coke, lignite, charcoal, peat, admixtures thereof and the like. The teachings relating to these materials, oils and carbonaceous oil slurries in U.S. Pat. No. 4,069,022—Metzger, issued Jan. 17, 1978, are incorporated by reference herein.

Oils suitable for these slurries include fuel oils such as No. 6 fuel oil, No. 2 fuel oil as well as other liquid petroleum products such as gas oils and crude oils used as fuel oils or the like.

Powdered coal used in these slurries may be pulverized bituminous, anthracite, or semi-bituminous coal. If desired, finely-divided solid carbonaceous materials such as powdered coke from coal or petroleum may be used in these slurries.

At room temperature, when a uniformly mixed coal oil slurry or coke oil slurry is prepared, the viscous fuel oil usually holds powdered coal in suspension. Later, when the coal oil slurry is heated so that the slurry can be pumped, the oil viscosity decreases and coal particles tend to settle. The quantity of dispersant added initially to the coal oil slurry should be sufficient to keep the coal particles suspended at elevated temperatures. To test the stabilizing effect of various additives, coal oil mixtures are prepared and then heat aged. The following procedure may be used to evaluate coal oil and coke oil slurries containing the stabilizer mixtures described above.

APPARATUS

1. One gallon jars with lids.
2. High speed laboratory stirrer.
3. Glass rod.
4. Glass jars with lids, 4 oz.
5. Constant temperature bath.

REAGENTS

1. Fuel oil No. 6.
2. Powdered coal 70 to 90% through 200 mesh.

PROCEDURE

1. Prepare a uniform coal in oil mixture in a one gallon jar. Disperse coal into heated oil kept between 55°–70° C. using agitation with a laboratory high speed stirrer. Agitation should continue until no lumps of coal are present in the mixture.

2. Repeat 1 using different coal to oil ratios to encompass the range of 90 oil/10 coal to 40 oil/60 coal.

3. Weigh aliquots of 100 g of coal in oil mixtures into 4 oz jars.

4. Add desired amount of stabilizer to each 100 g of coal in oil mixture. Seal system by tightly closing lid. Preferred level of addition for screening purposes is 0.5 g of stabilizer per 100 g of coal in oil mixture, i.e., 0.5 pph (0.5 part per hundred by weight). Thus, test a series of stabilizers simultaneously.

5. Place all jars into a constant temperature over kept at designated temperature and age samples.

6. Check settling of coal to bottom of the jar every 24 hours. If coal has settled to the bottom of the jar, reject the stabilizer and proceed aging with the remaining jars.

7. Check the degree of settling of coal to the bottom of the jar by slowly inserting a glass rod into the coal in oil mixture until it penetrates any sediment and hits the bottom of the jar. If the rod slides uninhibited by any coal sediment to the bottom of the jar, the stabilizer is acceptable. However, if the penetration of the rod is retarded by thickening of the mixture at the bottom of the jar or by a coal sediment at the bottom of the jar, the stabilizer should be rejected.

For a fuller understanding of the nature and advantages of this invention, reference may be made to the following examples. These examples are given merely to illustrate the invention and are not to be construed in a limiting sense. All quantities, proportions and percentages are by weight and all references to temperature are °C. unless otherwise indicated.

EXAMPLE I

Coal oil slurries were stabilized with stabilizer (A) an alkoxylated quaternary salt of a tertiary amine (control)

which is the reaction product of a cocoamine ethoxylate quaternarized with diethyl sulfate, stabilizer (B) a mixture of 90% by weight of the alkoxylated quaternary salt and 10% by weight of urea and stabilizer (C) a mixture of 90% by weight of the alkoxylated quaternary salt and 10% by weight of triethanolamine. The cocoamine ethoxylate was prepared by condensing two moles of ethylene oxide with one mole of amine.

The coal oil slurries were prepared using 40% by weight of powdered coal of which 80% passed through a 200 mesh sieve, 60% by weight of fuel oil No. 6 low viscosity having a Saybolt viscosity of 26 seconds at 122° F. and 0.25 pph (parts per hundred by weight) of stabilizer (A), (B) or (C). These slurries were tested using the evaluation procedure described above in the specification.

Samples of the stabilized coal oil slurries were placed in an oven at 65° C. and aged 7 days to accelerate sedimentation of coal particles. Sedimentation of each slurry was checked very slowly by inserting a glass rod into the coal oil slurry until it penetrated any sediment and touched the bottom of the jar.

| Stablilizer | Stability after 7 days at 65° C. |
|---|---|
| A (control) | sediment |
| B | good |
| C | good; slight thickening |
| Blank | packed sediment within 2 days |

EXAMPLE II

Coal oil slurries were prepared using 50% by weight of powdered coal of which 80% passed through a 200 mesh sieve, 48% by weight of waxy crude No. 6 high pour point Indonesian fuel oil, 2% by weight water and 0 to 1.0 pph (parts per hundred by weight) of stabilizer (A), (B) or (C) as described in Example I. These slurries were tested using the evaluation procedure described in the specification.

Samples of the stabilized coal oil slurries were placed in an oven at 65°–70° C. and aged 7 days to accelerate sedimentation of coal particles. Sedimentation of each slurry was checked very slowly by inserting a glass rod into the coal oil slurry until it penetrated any sediment and touched the bottom of the jar.

| Stabilizer | Stability after 7 days at 65–70° C. |
|---|---|
| A (control) | slight sediment |
| B | good; some thickening |
| C | good; some thickening |

EXAMPLE III

Coal oil slurries were prepared using 40% by weight of powdered coal of which 80% passed through a 200 mesh sieve, 56% by weight of fuel oil No. 6 low viscosity having a Saybolt viscosity of 26 seconds at 122° F. and 4% water. These slurries were prepared using stabilizers (A) and (B) as described in Example I as well as stabilizers (D) a mixture of 80% by weight of the alkoxylated quaternary salt from Example I and 20% urea, (E) a mixture of 90% by weight of the alkoxylated quaternary salt from Example I and 10% triethanolamine, (F) a mixture of 80% by weight of the alkoxylated quaternary salt from Example I and 20% triethanolamine, (G) a mixture of 90% by weight of the alkoxylated quaternary salt from Example I and 10% diethanolamine and (H) a mixture of 80% by weight of the alkoxylated quaternary salt from Example I and 20% diethanolamine. These stabilizers were added to the slurry at a concentration of 0.5 pph.

Samples of the stabilized coal oil slurries were placed in an oven at 70° C. and aged 8 days to accelerate sedimentation of coal particles. Sedimentation of each slurry was checked by slowly inserting a glass rod into the coal oil slurry until it penetrated any sediment and touched the bottom of the jar.

| Stabilizer | Stability after 8 days at 70° C. |
|---|---|
| Blank - no stabilizer | failed after 2 days |
| A | soft sediment |
| B | soft |
| D | sediment - harder pack |
| E | soft sediment |
| F | slight sediment |
| G | soft |
| H | slight sediment |

While the invention has been described with reference to certain specific embodiments thereof, it is understood that it is not to be so limited since alterations and changes may be made therein which are within the full intended scope of the appended claims.

What is claimed is:

1. An oil slurry of solid particulate carbonaceous material having a mixture of
   (a) from about 99% to about 75% by weight of an alkoxylated quaternary salt of
      (1) an alkoxylated primary aliphatic amine having from about 7 to about 29 carbon atoms and from about 2 to about 50 moles of an alkylene oxide having 2 to 3 carbon atoms per mole of amine, and
      (2) a quaternarizing agent, and
   (b) from about 1% to about 25% by weight of a nitrogen base having from 0 to 9 carbon atoms, the mixture being present in an amount sufficient to stabilize the slurry at elevated temperatures.

2. The slurry of claim 1 wherein the amine is a primary aliphatic amine of about 10 to about 18 carbon atoms.

3. The slurry of claim 1 wherein the nitrogen base is selected from the group consisting of ammonia, an amine having 1 to 9 carbon atoms, an alkanolamine having 1 to 9 carbon atoms and an amino base.

4. The slurry of claim 2 wherein the amino base is selected from the group consisting of urea, thiourea, dicyandiamide, ammeline, guanamines, guanidine and melamine.

5. The slurry of claim 1 wherein the powdered coal is present.

6. The slurry of claim 1 wherein the powdered coke is present.

7. The slurry of claim 1 wherein there is present from about 40 to about 90 parts by weight of oil, about 10 to about 60 parts by weight of particulate carbonaceous material, about 0 to about 10 parts by weight of water and about 0.01 to about 6 parts by weight of the mixture of alkoxylated quaternary salt and nitrogen base.

8. The slurry of claim 1 wherein the alkoxylated quaternary salt is a salt of a cocoamine ethoxylate and diethyl sulfate and the nitrogen containing base is urea.

9. The slurry of claim 1 wherein the alkoxylated quaternary salt is a salt of cocoamine ethoxylate and diethyl sulfate and the nitrogen containing base is triethanolamine.

10. The slurry of claim 1 wherein the alkoxylated quaternary salt is a salt of a cocoamine ethoxylate and diethyl sulfate and the nitrogen containing base is diethanolamine.

* * * * *